US012736268B2

(12) United States Patent
Zhu et al.

(10) Patent No.: US 12,736,268 B2
(45) **Date of Patent: *Sep. 15, 2026**

(54) REFRIGERATOR

(71) Applicants: QINGDAO HAIER REFRIGERATOR CO., LTD., Qingdao (CN); HAIER SMART HOME CO., LTD., Qingdao (CN)

(72) Inventors: Xiaobing Zhu, Qingdao (CN); Jianru Liu, Qingdao (CN); Dongqiang Cao, Qingdao (CN); Mengcheng Li, Qingdao (CN); Jing Wang, Qingdao (CN); Wei Li, Qingdao (CN); Shanshan Liu, Qingdao (CN); Yang Liu, Qingdao (CN); Yunxi Liu, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 110 days.

This patent is subject to a terminal disclaimer.

(21) Appl. No.: 18/827,178

(22) Filed: Sep. 6, 2024

(65) Prior Publication Data

US 2024/0426539 A1 Dec. 26, 2024

Related U.S. Application Data

(63) Continuation of application No. 17/434,291, filed as application No. PCT/CN2020/075705 on Feb. 18, 2020, now Pat. No. 12,111,093.

(30) Foreign Application Priority Data

Feb. 26, 2019 (CN) ..... 201910143330.9
Sep. 12, 2019 (CN) ..... 201910865912.8

(51) Int. Cl.
*F25D 17/00* (2006.01)
*F25D 17/06* (2006.01)
*F25D 23/00* (2006.01)

(52) U.S. Cl.
CPC ..... *F25D 17/067* (2013.01); *F25D 17/065* (2013.01); *F25D 23/003* (2013.01);
(Continued)

(58) Field of Classification Search
CPC .... F25D 23/003; F25D 11/022; F25D 17/065; F25D 2317/0682; F25D 2317/0683
See application file for complete search history.

(56) References Cited

U.S. PATENT DOCUMENTS 2,929,229 A 3/1960 Detwiler
2,994,207 A 8/1961 Pretole et al.
(Continued)

FOREIGN PATENT DOCUMENTS

CN 101706189 A 5/2010
CN 102410691 A 4/2012
(Continued)

OTHER PUBLICATIONS

International Search Report for PCT/CN2020/075705 (Isa/Cn) mailed May 14, 2020, with English translation (4 pages).
(Continued)

*Primary Examiner* — Eric S Ruppert
(74) *Attorney, Agent, or Firm* — troutman pepper locke; Tim Tingkang Xia, Esq.

(57) ABSTRACT

A refrigerator includes a lowermost storage liner, an evaporator, an air supply duct, and at least one air supply fan. A storage compartment and a cooling chamber positioned under the storage compartment are defined in the storage liner. The evaporator is disposed in the cooling chamber and is configured to cool air passing through the evaporator so as
(Continued)

to form cooling air supplied to the storage compartment. The air supply duct is disposed in a space defined by the storage liner and is configured to convey the cooling air cooled by the evaporator to the storage compartment. The air supply fan is disposed in the air supply duct and is configured to promote air circulation between the cooling chamber and the storage compartment.

12 Claims, 12 Drawing Sheets

(52) U.S. Cl.
CPC ..... *F25D 2317/065* (2013.01); *F25D 2317/0683* (2013.01); *F25D 2323/00261* (2013.01); *F25D 2323/00271* (2013.01)

(56) References Cited

U.S. PATENT DOCUMENTS

| | | | |
|---|---|---|---|
| 3,027,735 | A | 4/1962 | Preotle |
| 3,120,111 | A | 2/1964 | Simmons |
| 3,475,920 | A | 11/1969 | Jacobs |
| 2003/0167787 | A1 | 9/2003 | Ohashi |
| 2016/0231043 | A1 | 8/2016 | Casasanta et al. |
| 2017/0150829 | A1 | 6/2017 | Bates |

FOREIGN PATENT DOCUMENTS

| | | | |
|---|---|---|---|
| CN | 105783383 | A | 7/2016 |
| CN | 106813445 | A | 6/2017 |
| CN | 107062736 | A | 8/2017 |
| CN | 206600961 | U | 10/2017 |
| CN | 107621114 | A | 1/2018 |
| CN | 207035649 | U | 2/2018 |
| CN | 208475771 | U | 2/2019 |
| CN | 210832691 | U | 6/2020 |
| DE | 1033686 | B | 7/1958 |
| JP | 2000-180040 | A | 6/2000 |
| JP | 2005-201530 | A | 7/2005 |
| KR | 2011-0107653 | A | 10/2011 |

OTHER PUBLICATIONS

Written Opinion of the International Searching Authority for PCT/CN2020/075705 (Isa/Cn) mailed May 14, 2020, with English translation (3 pages).

1st Office Action for Australia Patent Application No. 2020229908 dated May 10, 2022 (3 pages).

Notice of Acceptance for Australia Patent Application No. 2020229908 dated Sep. 1, 2022 (3 pages).

1st Office Action for China Patent Application No. 201910865912.8 issued Sep. 13, 2024, w/English translation (19 pages).

Supplementary European Search Report for EP Patent Application No. 20763860.2 dated Mar. 31, 2022 (4 pages).

1st Office Action for EP Patent Application No. 20763860.2 dated Apr. 12, 2022 (5 pages).

2nd Office Action for EP Patent Application No. 20763860 dated Sep. 6, 2022 (5 pages).

Intention to Grant for EP Patent Application No. 20763860.2 date Jan. 10, 2023 (47 pages).

Extended European Search Report for EP Patent Application No. 23171638.2 dated Jul. 14, 2023 (8 pages).

REFRIGERATOR

CROSS REFERENCE TO RELATED APPLICATIONS

This application is a continuation of U.S. patent application Ser. No. 17/434,291 filed on Aug. 26, 2021, titled "Refrigerator," the contents of which is incorporated herein by reference in its entirety.

TECHNICAL FIELD

The present invention relates to the technical field of refrigeration and freezing, and in particular relates to a refrigerator.

BACKGROUND ART

In an existing refrigerator, an evaporator is generally positioned at the rear part of a lowermost storage space, which causes that the volume of the storage space in the front-and-rear direction is reduced, the depth of the storage space is limited, and the storage space is inconvenient to accommodate articles which are large in size and not easy to separate.

SUMMARY OF THE INVENTION

An object of the present invention is to provide a refrigerator with a large-volume storage compartment.

A further object of the invention is to reduce the space occupied by a cooling chamber and further increase the volume of the storage compartment.

Another further object of the invention is to improve the heat dissipation effect of a compressor chamber.

Specifically, the present invention provides a refrigerator, including:

a lowermost storage liner in which a space is defined, the space including a storage compartment and a cooling chamber positioned under the storage compartment;

an evaporator disposed in the cooling chamber and configured to cool air passing through the evaporator so as to form cooling air supplied to the storage compartment;

an air supply duct disposed in the space and configured to convey the cooling air to the storage compartment; and at least one air supply fan disposed in the air supply duct and configured to promote air circulation between the cooling chamber and the storage compartment.

Optionally, the air supply duct is disposed on the front side of the rear wall of the storage liner and in communication with the cooling chamber; and the at least one air supply fan is disposed at the lower end of the air supply duct, and configured to promote at least part of airflow cooled by the evaporator to be conveyed into the storage compartment through the air supply duct.

Optionally, the at least one air supply fan is vertically disposed at the lower end of the air supply duct.

Optionally, at least one first air outlet for blowing the cooling air to the storage compartment is formed in the front wall of the air supply duct.

Optionally, a containing groove protruding rearwards is formed in the lower end of the rear wall of the storage liner, and the air supply fan is disposed in the containing groove.

The rear wall face of the lower end of the air supply duct is matched with the rear wall of the containing groove, and the front wall face of the lower end of the air supply duct protrudes forwards; and The air supply fan is disposed in a space defined by the rear wall face of the lower end of the air supply duct and the front wall face of the lower end of the air supply duct.

Optionally, the air supply duct includes a first air duct section and a second air duct section which are sequentially in communication in an airflow flowing direction.

The at least one air supply fan is disposed in the second air duct section and is configured to promote the cooling air cooled by the evaporator to flow to the second air duct section through the first air duct section.

At least one second air outlet for blowing the cooling air to the storage compartment is formed in the second air duct section.

Optionally, the first air duct section is positioned on the front side of the rear wall of the storage liner, the second air duct section is positioned on the front side of the first air duct section, and the at least one second air outlet is formed in the front wall of the second air duct section.

Optionally, the first air duct section includes a first rear section positioned on the front side of the rear wall of the storage liner and extending upwards to be close to the top wall of the storage liner, and a first upper section extending forwards from the upper end of the first rear section.

The second air duct section includes a second upper section positioned under the first upper section and a second rear section extending downwards from the rear end of the second upper section and positioned in front of the first rear section.

The at least one air supply fan is disposed at a position close to the front end of the second upper section, at least one second air outlet is formed in a position close to the front end of the lower wall of the second upper section, and at least one second air outlet is formed in the front wall of the second rear section.

Optionally, the at least one air supply fan includes a plurality of air supply fans, and the plurality of air supply fans are distributed at intervals in a lateral direction.

Optionally, the evaporator is in a flat box shape and laterally arranged in the cooling chamber.

Optionally, the refrigerator further includes:

a housing disposed in the space defined by the storage liner and configured to divide the space into the cooling chamber and the storage compartment.

The housing covers the bottom wall of the storage liner, and defines the cooling chamber together with the bottom wall and two lateral side walls of the storage liner.

Optionally, a front return air inlet is formed in the front wall of the housing, so that return air of the storage compartment enters the cooling chamber through the front return air inlet and is cooled by the evaporator.

An air duct inlet in communication with the cooling chamber is formed in the front wall face of the lower end of the air supply duct.

An airflow outlet of the cooling chamber in communication with the air duct inlet is formed in the rear end of the housing.

Optionally, the storage liner is a freezing liner, and the storage compartment is a freezing chamber.

The refrigerator further includes:

two variable-temperature liners distributed in a lateral direction and positioned right above the freezing liner, a variable-temperature chamber being defined in each of the variable-temperature liners; and a refrigerating liner positioned right above the two variable-temperature liners, a refrigerating chamber being defined in the refrigerating liner.

Optionally, a compressor chamber is also defined in the refrigerator, and the compressor chamber is positioned on the lower rear side of the cooling chamber.

Optionally, a compressor, a heat dissipation fan and a condenser which are distributed at intervals in a lateral direction are arranged in the compressor chamber.

A bottom air inlet close to the condenser and a bottom air outlet close to the compressor which are distributed in a lateral direction are defined in the bottom wall of the refrigerator.

The heat dissipation fan is further configured to suck ambient air from the bottom air inlet and promote the air to pass through the condenser first, further pass through the compressor and then flow to the ambient environment from the bottom air outlet.

Optionally, the refrigerator further includes:

a bottom plate including a bottom horizontal section positioned on the front side of the bottom and a bent section bending and extending rearwards and upwards from the rear end of the bottom horizontal section, the bent section including an inclined section positioned above the bottom air inlet and the bottom air outlet;

a supporting plate positioned behind the bottom horizontal section, wherein the bent section extends to the upper side of the supporting plate, the supporting plate and the bottom horizontal section form a bottom wall of the refrigerator, and the supporting plate and the bottom horizontal section are spaced apart so as to define a bottom opening by the rear end of the bottom horizontal section and the front end of the supporting plate;

two side plates extending upwards from two lateral sides of the supporting plate to two lateral sides of the bent section respectively to form two lateral side walls of the compressor chamber; and a vertically-extending back plate extending upwards from the rear end of the supporting plate to the rear end of the bent section to form the rear wall of the compressor chamber.

The compressor, the heat dissipation fan and the condenser are sequentially arranged on the supporting plate at intervals in the lateral direction and positioned in a space defined by the supporting plate, the two side plates, the back plate and the bent section.

The refrigerator further includes a divider disposed behind the bent section, wherein the front part of the divider is connected with the rear end of the bottom horizontal section, the rear part of the divider is connected with the front end of the supporting plate, and the divider is disposed to divide the bottom opening into the bottom air inlet and the bottom air outlet which are distributed in a lateral direction.

Optionally, the refrigerator further includes:

a wind blocking strip extending forwards and rearwards, wherein the wind blocking strip is positioned between the bottom air inlet and the bottom air outlet, extends to the lower surface of the supporting plate from the lower surface of the bottom horizontal section and is connected to the lower end of the divider, so as to completely isolate the bottom air inlet from the bottom air outlet through the wind blocking strip and the divider, so that when the refrigerator is placed on a supporting surface, the space between the bottom wall of the refrigerator and the supporting surface is laterally separated to allow external air to enter the compressor chamber through the bottom air inlet positioned on one lateral side of the wind blocking strip under the action of the heat dissipation fan, sequentially flow through the condenser and the compressor, and finally flow out of the bottom air outlet positioned on the other lateral side of the wind blocking strip.

According to the refrigerator, the air supply fan is disposed in the air supply duct, so that the air supply fan does not occupy the space of the cooling chamber any more, the size of the evaporator in the front-back direction can be increased, the size of the evaporator in the height direction can be reduced, the height of the cooling chamber is prevented from being affected by the height of the evaporator, and the size of the cooling chamber in the vertical direction does not need to be increased for accommodating the air supply fan. Therefore, the occupied space of the cooling chamber is reduced from two aspects, and the storage volume of the storage compartment above the cooling chamber is increased.

In addition, the distance between the air supply fan and the evaporator is relatively increased, so that the degree of frosting of blades can be reduced; the distance between the air supply fan and a water outlet is also relatively increased, the volume of hot air sucked by the air supply fan from the water outlet can be reduced, and therefore the influence of the hot air on temperature rise of the storage compartment is reduced. Moreover, since the size of the evaporator in the front-back direction is increased, the coverage of the water outlet is increased, the hot air entering from the water outlet can be cooled by the evaporator, and the temperature of the storage compartment is prevented from rising.

Further, according to the refrigerator, by improving the structure of the air supply duct and improving the position of the air supply fan, the problem of frosting of the blades of the air supply fan can be completely avoided, and therefore refrigerating performance of the refrigerator is improved.

Furthermore, in the refrigerator, the bottom air inlet and the bottom air outlet which are distributed in a lateral direction are defined in the bottom wall of the refrigerator, heat dissipating airflow completes circulation at the bottom of the refrigerator, and the space between the refrigerator and the supporting surface is fully utilized, so that the distance between the rear wall of the refrigerator and a cupboard does not need to be increased, and good heat dissipation of the compressor chamber is ensured while the occupied space of the refrigerator is reduced.

Still further, in the refrigerator, the bottom air inlet and the bottom air outlet are completely isolated through the wind blocking strip and the divider, which guarantees that no cross flow of the external air entering the condenser and the hot air exhausted from the compressor exists, thus improving the heat dissipation effect, and guaranteeing normal operation of a refrigerating system of the refrigerator.

According to the following detailed descriptions of specific embodiments of the present invention in conjunction with the drawings, those skilled in the art will more clearly understand the above and other objectives, advantages and features of the present invention.

BRIEF DESCRIPTION OF THE DRAWINGS

Some specific embodiments of the present invention are described in detail below with reference to the drawings by way of example and not limitation. The same reference numerals in the drawings indicate the same or similar components or parts. Those skilled in the art should understand that these drawings are not necessarily drawn in scale. In drawings.

DETAILED DESCRIPTION OF THE INVENTION

Figure 1:
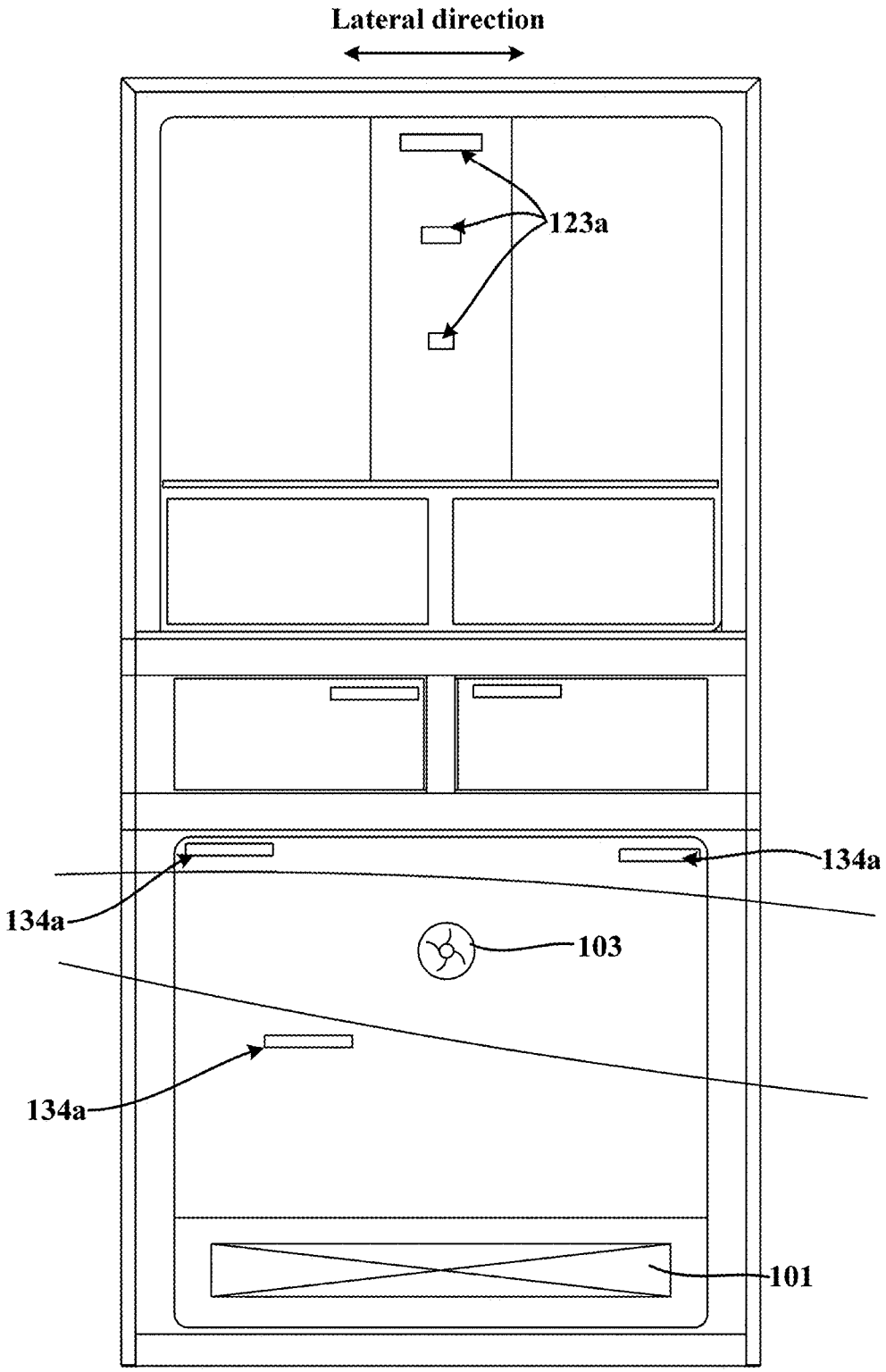
FIG. 1 is a schematic diagram of a refrigerator according to an embodiment of the present invention, with one air supply fan.

The present embodiment provides a refrigerator 100, which is described below with reference to FIG. 1 to FIG. 11. For convenience of description, orientations such as "on", "under", "front", "rear", "top", "bottom", and "lateral" mentioned in the specification are defined according to a spatial position relationship of the refrigerator 100 in a normal operating state. For example, as shown in FIG. 1, a lateral direction refers to a direction parallel to the width direction of the refrigerator 100.

Referring to FIG. 4*a* to FIG. 9. the refrigerator 100 includes a cabinet that generally includes a shell 110 and a storage liner disposed on the inner side of the shell 110, a space between the shell 110 and the storage liner being filled with a thermal insulation material (formed into a foamed layer). A storage compartment 131 is defined in the storage liner 130.

As can be appreciated by those skilled in the art, the cabinet further defines a cooling chamber 136 and a compressor chamber, and the refrigerator 100 may further include an evaporator 101, an air supply fan 103, a compressor 104, a condenser 105, a throttling element (not shown) and the like. The evaporator 101 is disposed in the cooling chamber 136. The compressor 104 and the condenser 105 are disposed in the compressor chamber. The evaporator 101 is connected with the compressor 104, the condenser 105 and the throttling element through a refrigerant pipeline to form a refrigeration circulation loop, so as to cool down upon starting of the compressor 104 to cool air flowing therethrough. The shell 110 and each liner (explained in further detail below) are thermally insulated through the foamed layer, and correspondingly, the compressor chamber and the cooling chamber 136 are also thermally insulated through the foamed layer.

Figure 4A:
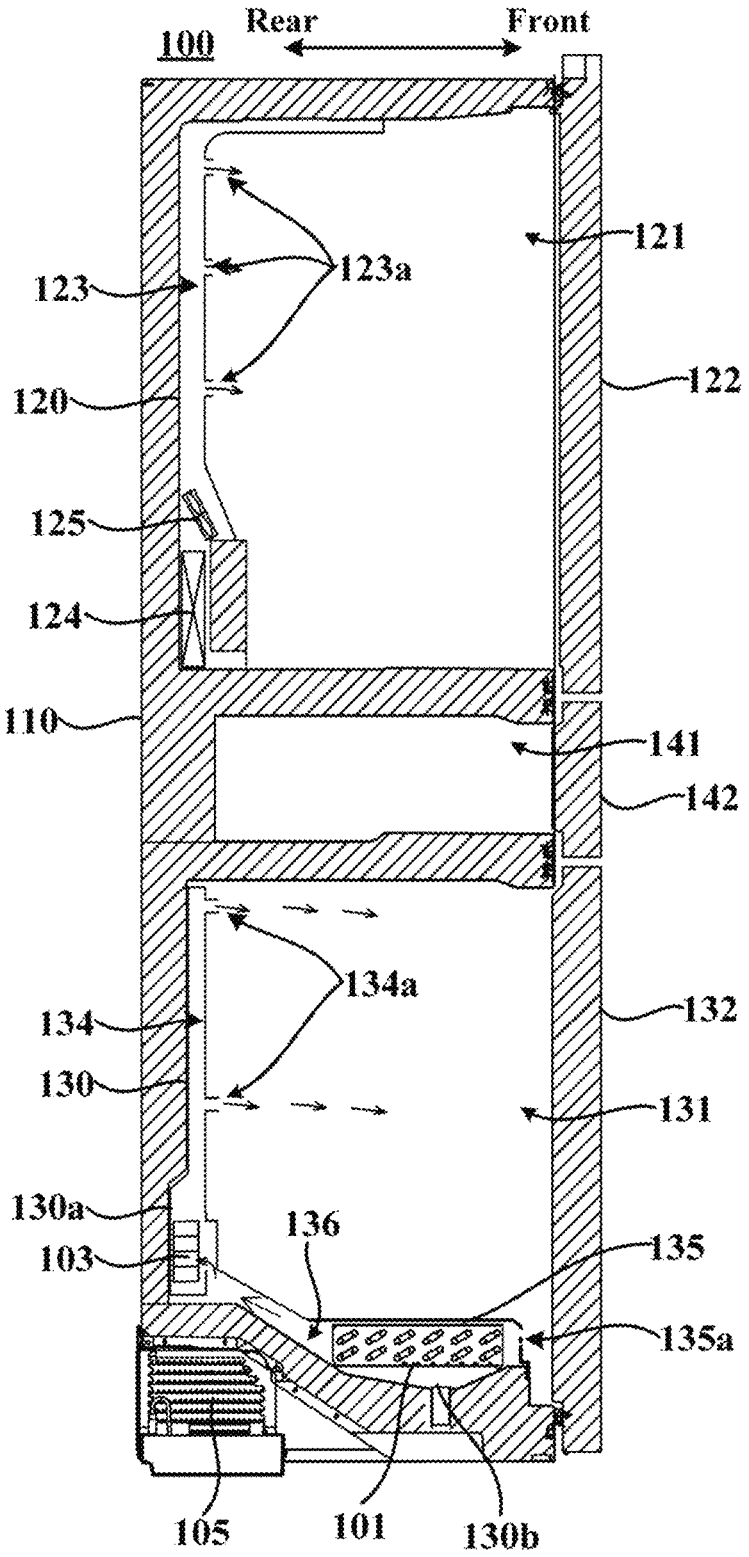
FIG. 4*a* and FIG. 4*b* are side cross-sectional schematic diagrams of a refrigerator according to an embodiment of the present invention respectively, with the air supply fan positioned at the lower end of the air supply duct.
Figure 4B:
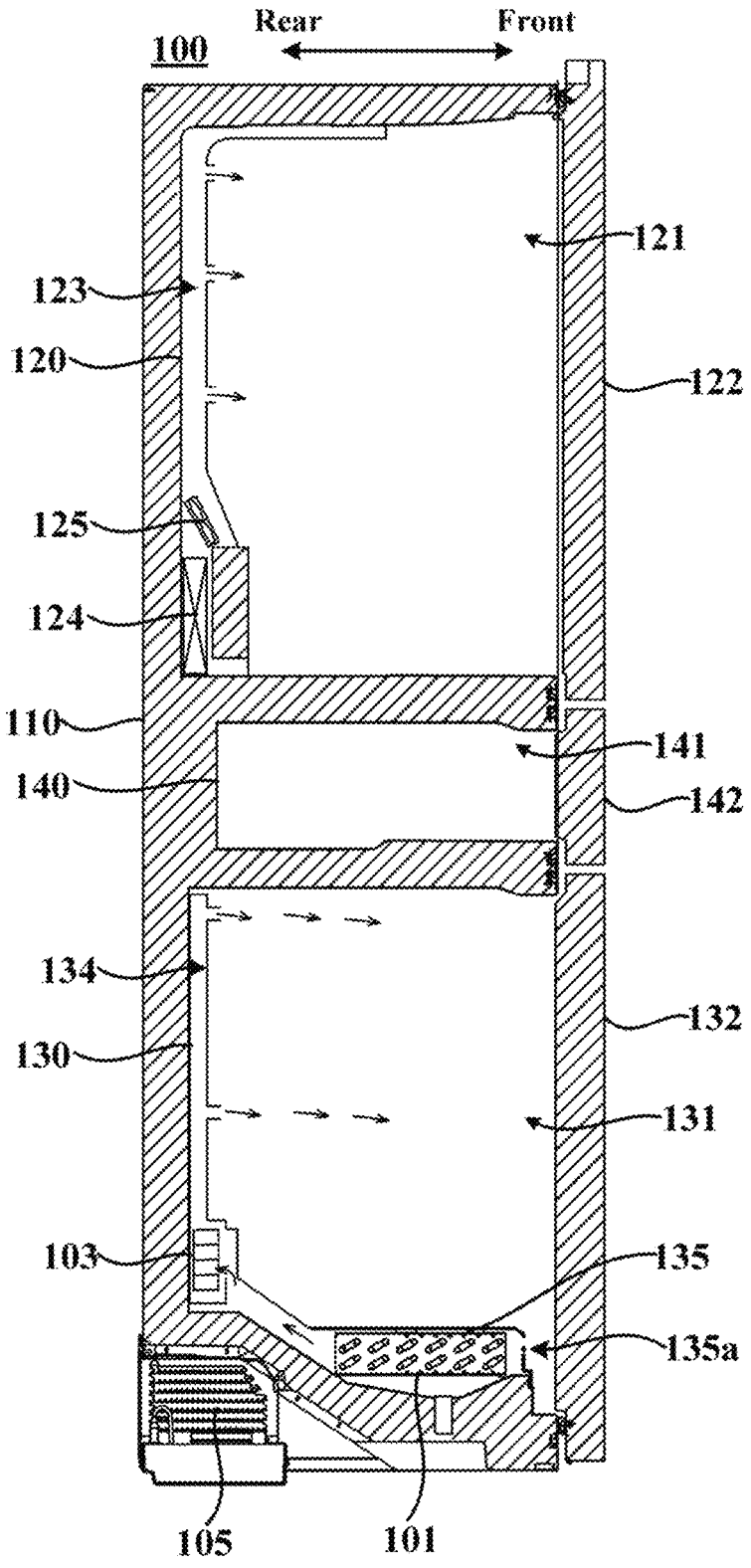

Particularly, referring to FIG. 4*a* and FIG. 4*b*, in some embodiments, the cooling chamber 136 is defined by the storage liner 130. Specifically, the cooling chamber 136 under the storage compartment 131 is further defined in the lowermost storage liner 130, and an air supply duct 134 is disposed in the space defined by the storage liner 130, positioned on the inner side of the rear wall of the storage liner 130, and in communication with the cooling chamber 136. At least one air supply fan 103 is disposed in the air supply duct 134 and configured to promote air circulation between the cooling chamber 136 and the storage compartment 131.

In some embodiments, the air supply fan 103 is vertically disposed at the lower end of the air supply duct 134 and configured to promote at least part of airflow cooled by the evaporator 101 to be conveyed into the storage compartment 131 through the air supply duct 134.

The lowermost storage liner 130 is a freezing liner, and the storage compartment 131 defined by the storage liner 130 is a freezing chamber. The freezing chamber has the lowest temperature relative to a variable-temperature chamber and a refrigerating chamber, and the cooling chamber 136 is distributed under the freezing chamber, which is beneficial to maintain the lowest temperature of the freezing chamber. A freezing chamber door body 132 is disposed on the front side of the freezing liner to open and close the storage freezing chamber.

In previous patents applied by applicants of the present invention, the air supply fan 103 is positioned in the cooling chamber 136 and behind the evaporator 101. The air supply fan 103 has a certain height, which causes that the height of the upper wall of the cooling chamber 136 is relatively high, and the height space occupied by the cooling chamber 136 is increased. Also, the air supply fan 103 is positioned behind the evaporator 101, and some space is occupied in the front-back direction, which causes that the size of the evaporator 101 in the front-back direction is limited, and only the height of the evaporator 101 can be increased in the height direction to ensure reasonable heat exchange area of the evaporator 101, which further causes that the upper wall of the cooling chamber 136 is higher, the larger space is occupied, and the volume of the storage compartment 131 above the cooling chamber 136 is reduced.

Based on the problems above, in the refrigerator 100 provided by the present embodiment, the position of the air supply fan 103 is adjusted to the lower end of the air supply duct 134, and the air supply fan is vertically disposed behind the evaporator 101. That is, the air supply fan 103 does not occupy the space of the cooling chamber 136 anymore, but moves to a higher position behind the evaporator 101, so that the size of the evaporator 101 in the front-back direction can be increased, and the size of the evaporator in the height direction can be decreased, and the height of the top wall of the cooling chamber 136 does not need to be increased due to the height of the air supply fan 103. Therefore, the height of the cooling chamber 136 is reduced from two aspects, and the storage volume of the storage compartment 131 above the cooling chamber 136 is increased.

In some embodiments, referring to FIG. 4*a* and FIG. 4*b*, the air supply fan 103 may be a centrifugal fan, and the air supply fan 103 being vertically arranged means that a rotating shaft of the air supply fan 103 is perpendicular to the vertical plane.

An air duct inlet (not numbered) in communication with the cooling chamber 136 is formed in the front wall face of the lower end of the air supply duct 134, and under the driving of the air supply fan 103, airflow cooled by the evaporator 101 in the cooling chamber 136 flows into the air supply duct 134 and is blown into the storage compartment 131 through the air supply duct 134. The air supply duct 134 is provided with at least one first air outlet 134*a* in communication with the storage compartment 131.

In addition, compared with a traditional refrigerator 100 in which the cooling chamber 136 is positioned behind the storage compartment 131, the refrigerator 100 of the present embodiment has the advantages that the cooling chamber 136 does not occupy the space behind the storage compartment 131 anymore, the depth of the storage compartment 131 is increased, and the storage volume of the storage compartment 131 is further increased. Moreover, due to the existence of the cooling chamber 136, the height of the storage compartment 131 thereabove is increased, the bend degree of a user when taking articles from the storage compartment 131 or placing thereto is reduced, the user experience is improved, and the refrigerator is particularly convenient for the elderly to use.

In some more specific embodiments, the refrigerator 100 includes a lowermost storage liner 130, a housing 135, an evaporator 101, and at least one air supply fan 103. The housing 135 is disposed within a space defined by the storage liner 130 and configured to divide the space into a cooling chamber 136 positioned below and a storage compartment 131 positioned above the cooling chamber 136. The evaporator 101 is disposed in the cooling chamber 136 and configured to cool air flowing through the evaporator so as to form cooling air supplied to the storage compartment 131, and the air supply fan 103 is configured to promote the air to circularly flow between the cooling chamber 136 and the storage compartment 131, so that the cooling air can be continuously supplied to the storage compartment 131, to ensure that the temperature of the storage compartment 131 can reach a corresponding target temperature. Specifically, in some embodiments, the housing 135 covers the bottom wall of the storage liner 130, and defines the cooling chamber 136 together with the bottom wall and two lateral side walls of the storage liner 130, an airflow outlet (not numbered) of the cooling chamber in communication with the air duct inlet of the air supply duct 134 is formed in the rear end of the housing 135, a front return air inlet 135*a* is formed in the front wall of the housing 135, and return airflow of the storage compartment 131 enters the cooling chamber 136 through the front return air inlet 135*a* and is cooled by the evaporator 101.

In the traditional refrigerator, the lowermost space of the refrigerator is generally a storage space, the position of the storage space is relatively low, and the user needs to bend down or squat greatly to take the articles from the lowermost storage space or place thereto, which causes the traditional refrigerator is inconvenient to use, especially for the elderly. Also, the evaporator of the traditional refrigerator is generally positioned behind the lowermost storage space and occupies the area behind the lowermost storage space, so that the depth of the lowermost storage space is reduced. Moreover, the compressor chamber of the traditional refrigerator is generally positioned on the lower rear side of the lowermost storage space, and the lowermost storage space inevitably needs to give way to the compressor chamber, which causes that the lowermost storage space is special-shaped, the volume of the lowermost storage space is further reduced, and the storage space is inconvenient to store the articles which are large in size and not easy to divide.

In order to solve various problems of the traditional refrigerator, prior to the present application, applicants of the present invention designed a novel refrigerator with an evaporator at the bottom. The common point of the novel refrigerator and the refrigerator 100 of the present embodiment is that the cooling chamber 136 is defined by the lowermost storage liner 130, and the storage compartment 131 defined by the storage liner 130 is positioned above the cooling chamber 136. According to the refrigerator 100 with such design, due to the fact that the lowest space of the refrigerator 100 is the cooling chamber 136, the height of the storage compartment 131 above the cooling chamber 136 is raised, the bend degree of the user when taking the articles from the storage compartment 131 or placing thereto is reduced, and the user experience is improved. In addition, the evaporator 101 does not occupy the rear space of the storage compartment 131 anymore, and the depth of the storage compartment 131 is guaranteed.

Also, the compressor chamber can be positioned on the lower rear side of the cooling chamber 136, the cooling chamber 136 gives way to the compressor chamber, and the storage compartment 131 does not need to give way to the compressor chamber, so that a rectangular space with large volume and regular shape can be formed, and is convenient to accommodate the articles which are large in size and not easy to divide, and the problem that the large articles cannot be placed in the storage compartment 131 is solved.

However, in the novel evaporator, the air supply fan 103 is positioned in the cooling chamber 136 and behind the evaporator 101. The air supply fan 103 has a certain height, which causes that the height of the upper wall of the cooling chamber 136 is relatively high, and the height space occupied by the cooling chamber 136 is increased. Also, the air supply fan 103 is positioned behind the evaporator 101, and occupies some space in the front-back direction, which causes that the size of the evaporator 101 in the front-back direction is limited, and only the height of the evaporator 101 can be increased in the height direction to ensure reasonable heat exchange area of the evaporator 101, which further causes that the upper wall of the cooling chamber 136 is higher, the larger space is occupied, and the volume of the storage compartment 131 above the cooling chamber 136 is reduced. In addition, if there is a gap between the housing 135 and the evaporator 101, return air of the storage compartment 131 will pass through the gap to enter the air supply fan 103, which causes frosting of blades of the air supply fan 103 and reduction of rotational speed of the air supply fan 103, reduces air volume, and adversely affects refrigeration performance. Moreover, since the air supply fan 103 is close to a water outlet 130*b* (the water outlet 130*b* for discharging water from frost of the evaporator 101 is formed in the bottom wall of the storage liner 130), hot air outside the refrigerator enters the cooling chamber 136 through the water outlet 130*b*, and is easy to be directly sucked by the air supply fan 103 without being cooled by the evaporator 101, and be sent to the storage compartment 131, resulting in that the temperature of the storage compartment 131 rises, and adverse effects are brought to the fresh-keeping quality of food materials.

In order to solve the problems above, the applicants of the present application make modifications on the setting position of the air supply fan 103. The air supply fan 103 is disposed in the air supply duct 134, so that the air supply fan 103 does not occupy the space of the cooling chamber 136 anymore, the size of the evaporator 101 in the front-back direction can be increased, the size of the evaporator in the height direction can be reduced, the height of the cooling chamber 136 is prevented from being affected by the height of the evaporator 101, and the size of the cooling chamber 136 in the vertical direction does not need to be increased for accommodating the air supply fan 103. Therefore, the occupied space of the cooling chamber 136 is reduced from two aspects, and the storage volume of the storage compartment 131 above the cooling chamber 136 is increased. In addition, the distance between the air supply fan 103 and the evaporator 101 is relatively increased, so that the degree of frosting of the blades can be reduced; the distance between the air supply fan 103 and the water outlet 130*b* is also relatively increased, the volume of the hot air sucked by the air supply fan 103 from the water outlet 130*b* can be reduced, and therefore the influence of the hot air on temperature rise of the storage compartment is reduced. Moreover, since the size of the evaporator 101 in the front-back direction is increased, the coverage of the water outlet 130*b* is increased, the hot air entering from the water outlet 130*b* can be cooled by the evaporator 101, and the temperature of the storage compartment 131 is prevented from rising.

Figure 2:
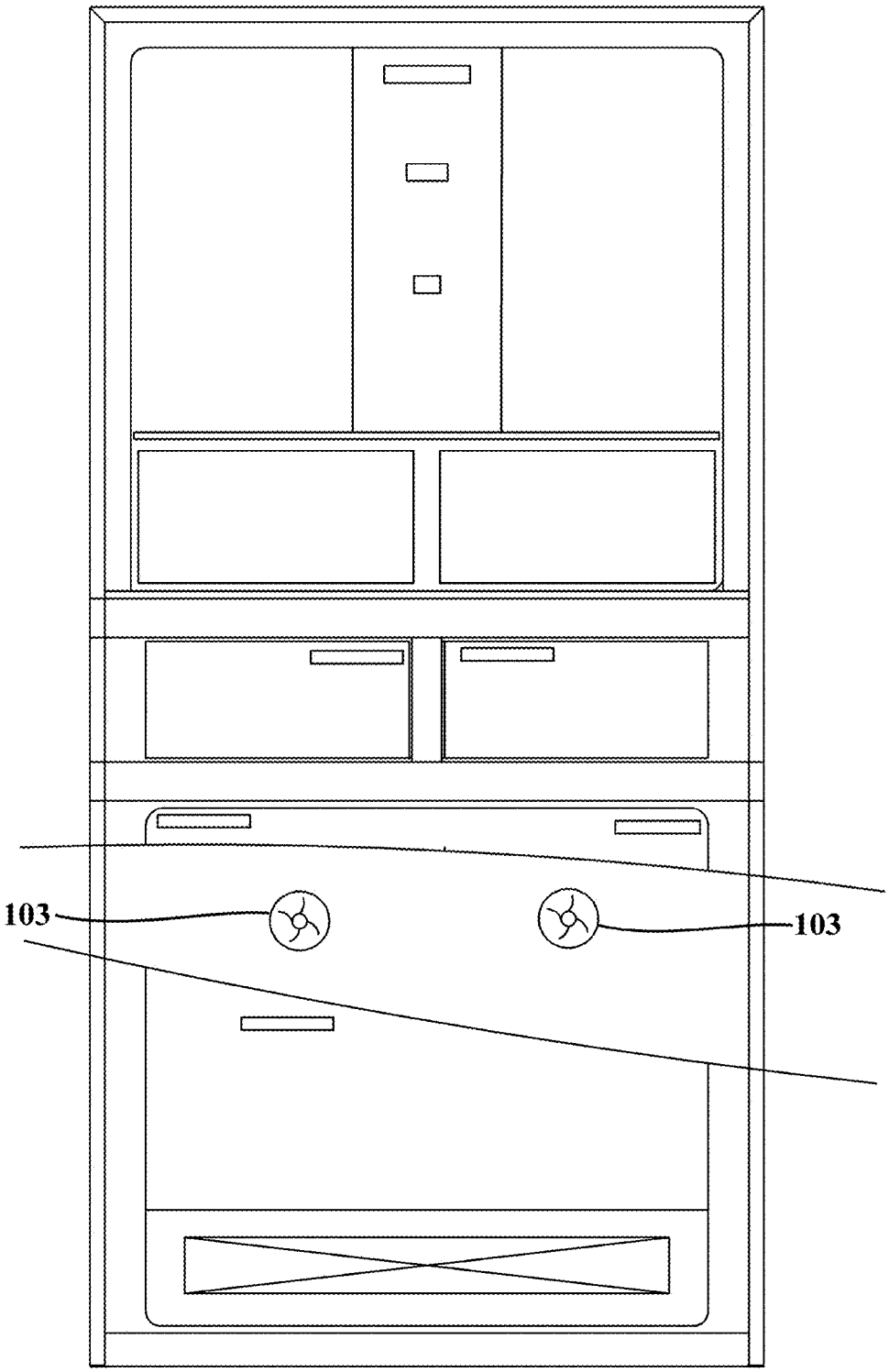
FIG. 2 is a schematic diagram of a refrigerator according to an embodiment of the present invention, with two air supply fans.
Figure 3:
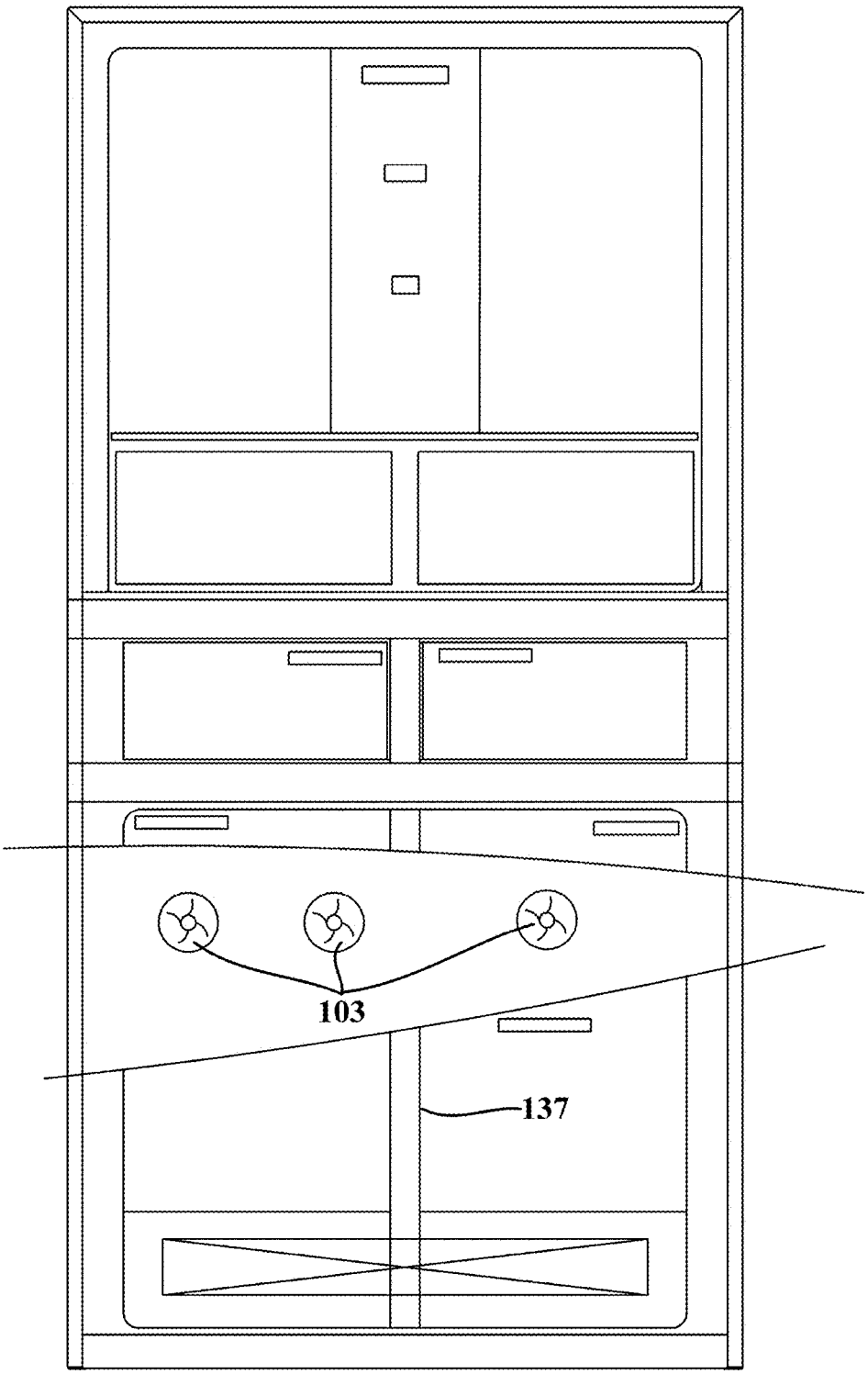
FIG. 3 is a schematic diagram of a refrigerator according to an embodiment of the present invention, with three air supply fans.

In some embodiments, as shown in FIG. 1, there may be one air supply fan 103 to reduce cost. In some embodiments, as shown in FIG. 2 and FIG. 3, there may be a plurality of air supply fans 103, a plurality means two or more, and the plurality of air supply fans 103 are distributed at intervals in the lateral direction to increase the air supply volume and improve the refrigeration speed of the refrigerator 100. The housing 135 is not shown in FIG. 1 to FIG. 3 to illustrate the evaporator 101.

In some embodiments, a vertical partition plate 137 may be disposed in the space defined by the storage liner 130, and divides the space defined by the storage liner 130 into two storage compartments 131 that are distributed in the lateral direction. At least one air supply fan 103 is disposed in the section of the air supply duct 134 corresponding to one storage compartment 131, and at least one another air supply fan 103 is disposed in the section of the air supply duct 134 corresponding to the other storage compartment 131, so that a relative large air supply volume of the two storage compartments 131 is guaranteed. For example, as shown in FIG. 3, two air supply fans 103 are disposed in the section of the air supply duct 134 corresponding to the storage compartment 131 on the lateral left side, and one air supply fan 103 is disposed in the section of the air supply duct 134 corresponding to the storage compartment 131 on the lateral right side, so that the storage compartment 131 on the left side can have a larger air supply volume than the storage compartment 131 on the right side and can be used as a freezing chamber, and the storage compartment 131 on the right side can be used as a variable-temperature chamber.

In some embodiments, the air supply duct 134 may be disposed on the front side of the rear wall of the storage liner 130, at least one first air outlet 134*a* for blowing the cooling air to the storage compartment 131 is formed in the front wall of the air supply duct, and the at least one air supply fan 103 is disposed at the lower end of the air supply duct 134. In the present embodiment, since the air supply fan 103 is positioned at the lower end of the air supply duct 134, the thickness of the air supply duct 134 is increased only at the position where the air supply fan 103 is arranged, so that the depth of the storage compartment 131 can be guaranteed. There may be a plurality of first air outlets 134*a*, as shown in FIG. 4*a*, the plurality of first air outlets 134*a* are sequentially distributed at intervals from top to bottom so as to supply air to different areas in the height direction of the storage compartment 131, which is beneficial to maintain temperature uniformity of the storage compartment 131.

In some embodiments, the refrigerator 100 further includes a refrigerating liner 120 and two variable-temperature liners 140, the two variable-temperature liners 140 being distributed right above the storage liner 130 in the lateral direction, and the refrigerating liner 120 being positioned right above the two variable-temperature liners 140.

A variable-temperature chamber 141 is defined in each variable-temperature liner 140, and a variable-temperature chamber door body 142 is disposed on the front side of each variable-temperature liner 140 to open and close the corresponding variable-temperature chamber 141. A refrigerating chamber door body 122 is disposed on the front side of the refrigerating liner 120 to open and close the refrigerating chamber 121. In some embodiments, the refrigerator 100 further includes two variable-temperature chamber air supply ducts (not shown) and two variable-temperature chamber air return ducts (not shown) in one-to-one correspondence with the two variable-temperature liners 140. The variable-temperature chamber air supply ducts can be in controllable communication with the air supply duct 134 through variable-temperature chamber air doors, and the variable-temperature chamber return air ducts are provided with inlets in communication with the variable-temperature liners 140 and outlets in communication with the cooling chamber 136, so that return airflow of the variable-temperature chambers 141 can be conveyed into the cooling chamber 136.

The variable-temperature chamber air supply ducts and the variable-temperature chamber return air ducts can be disposed according to the number of the variable-temperature liners 140, for example, there may be one or more variable-temperature chamber air supply ducts and variable-temperature chamber return air ducts.

In some embodiments, as shown in FIG. 4*a* and FIG. 4*b*, the refrigerating chamber 121 can have an independent refrigerating evaporator 124 and a refrigerating air supply fan 125. The refrigerating evaporator 124 and the refrigerating air supply fan 125 are disposed in a refrigerating chamber air supply duct 123 positioned on the inner side of the rear wall of the refrigerating liner 120, and the refrigerating chamber air supply duct 123 is provided with a refrigerating chamber air supply port 123*a* that supplies air to the refrigerating chamber 121.

In some embodiments, a containing groove 130*a* protruding rearwards may be formed at the lower end of the rear wall of the storage liner 130, and the air supply fan 103 is disposed in the containing groove 130*a*, so that the space occupied by the air supply fan 103 is reduced and the volume of the storage compartment 131 is increased.

Furthermore, in a preferred embodiment, as shown in FIG. 4*a*, the rear wall face of the lower end of the air supply duct 134 can be matched with the rear wall of the containing groove 130*a*, the front wall face of the lower end of the air supply duct 134 protrudes forwards, and the air supply fan 103 is disposed in a space defined by the rear wall face of the lower end and the front wall face of the lower end of the air supply duct 134. Due to the existence of the containing groove 130*a*, the size of the front wall face protruding forwards of the lower end of the air supply duct 134 is reduced, so that the volume of the storage compartment 131 in front can be increased, and the influence of the air supply fan 103 on the increase of the thickness of the air supply duct 134 is further reduced.

In some embodiments, as shown in FIG. 5 to FIG. 9, the air supply duct 134 may include a first air duct section 1341 and a second air duct section 1342 which sequentially communicate with each other in an air flowing direction. The at least one air supply fan 103 is disposed in the second air duct section 1342 and configured to promote the cooling air cooled by the evaporator 101 to flow to the second air duct section 1342 through the first air duct section 1341, and at least one second air outlet 1342*a* for blowing the cooling air to the storage compartment 131 is formed in the second air duct section 1342. In the present embodiment, the air supply duct 134 is improved. The air supply duct 134 is designed to be the first air duct section 1341 at the upstream and the second air duct section 1342 at the downstream, and the air supply fan 103 is disposed in the second air duct section 1342, so that the distance between the air supply fan 103 and the evaporator 101 is further increased. If a gap exists between the housing 135 and the evaporator 101, return air of the storage compartment 131 first flows through the first air duct section 1341 and is cooled by the cooling air cooled by the evaporator 101, so that the problem of frosting of blades of the air supply fan 103 can be completely avoided. Also, the distance between the air supply fan 103 and the water outlet 130*b* is further increased, and hot air which enters through the water outlet 130*b* and is not cooled by the evaporator 101 first flows through the first air duct section 1341 and is cooled by the cooling air cooled by the evaporator 101, so that adverse effects on the temperature of the storage compartment 131 can be completely avoided, and the fresh-keeping quality of food materials is favorably improved.

Referring to FIG. 5 to FIG. 8, the first air duct section 1341 can be positioned on the front side of the rear wall of the storage liner 130, the second air duct section 1342 can be positioned on the front side of the first air duct section, and at least one of the second air outlets 1342*a* is formed in the front wall of the second air duct section 1342. There may be a plurality of second air outlets 1342*a*, and the plurality of second air outlets 1342*a* are sequentially distributed at intervals from top to bottom so as to supply air to different areas in the height direction of the storage compartment 131, which is beneficial to maintain temperature uniformity of the storage compartment 131.

Figure 5:
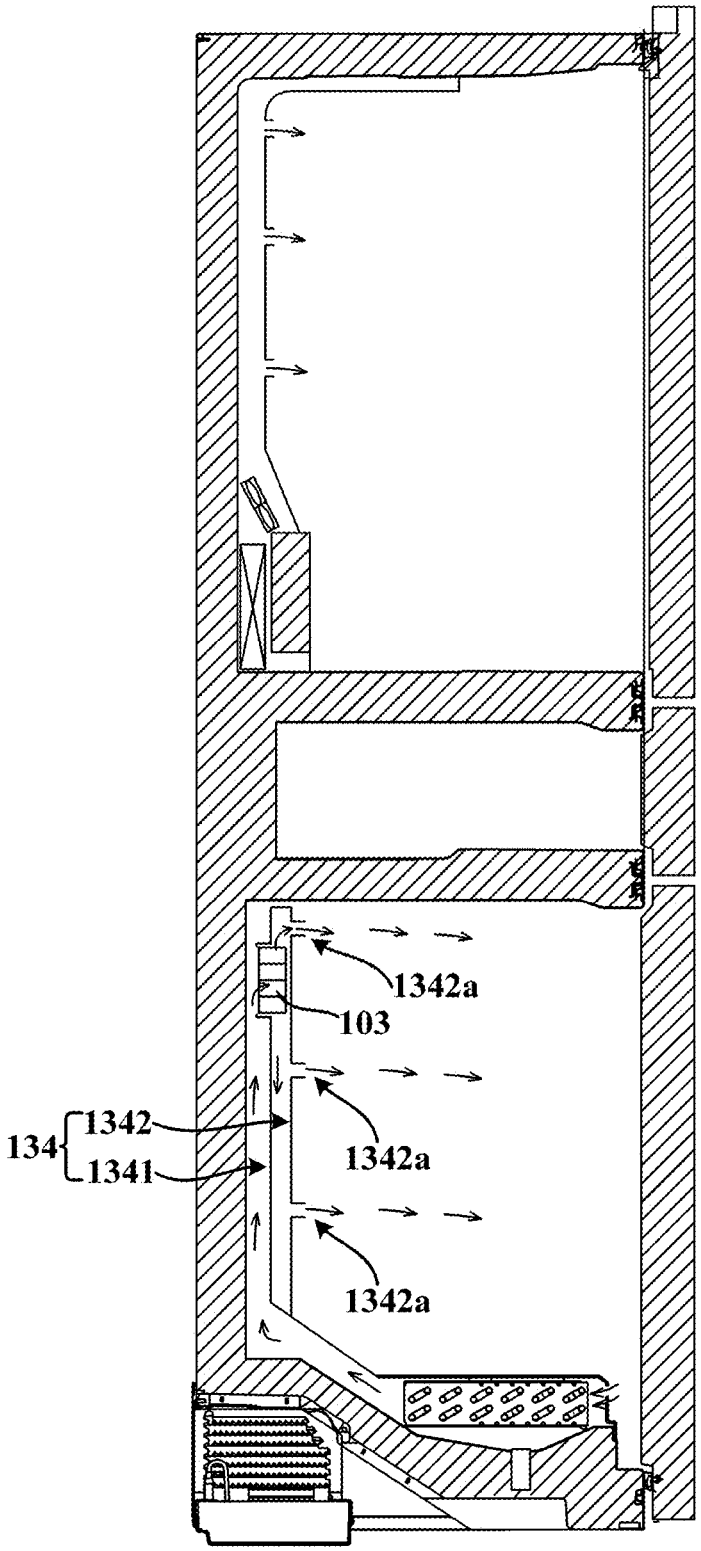
FIG. 5 is a side cross-sectional schematic diagram of a refrigerator according to an embodiment of the present invention, with the air supply fan positioned at the upper end of the air supply duct.
Figure 7:
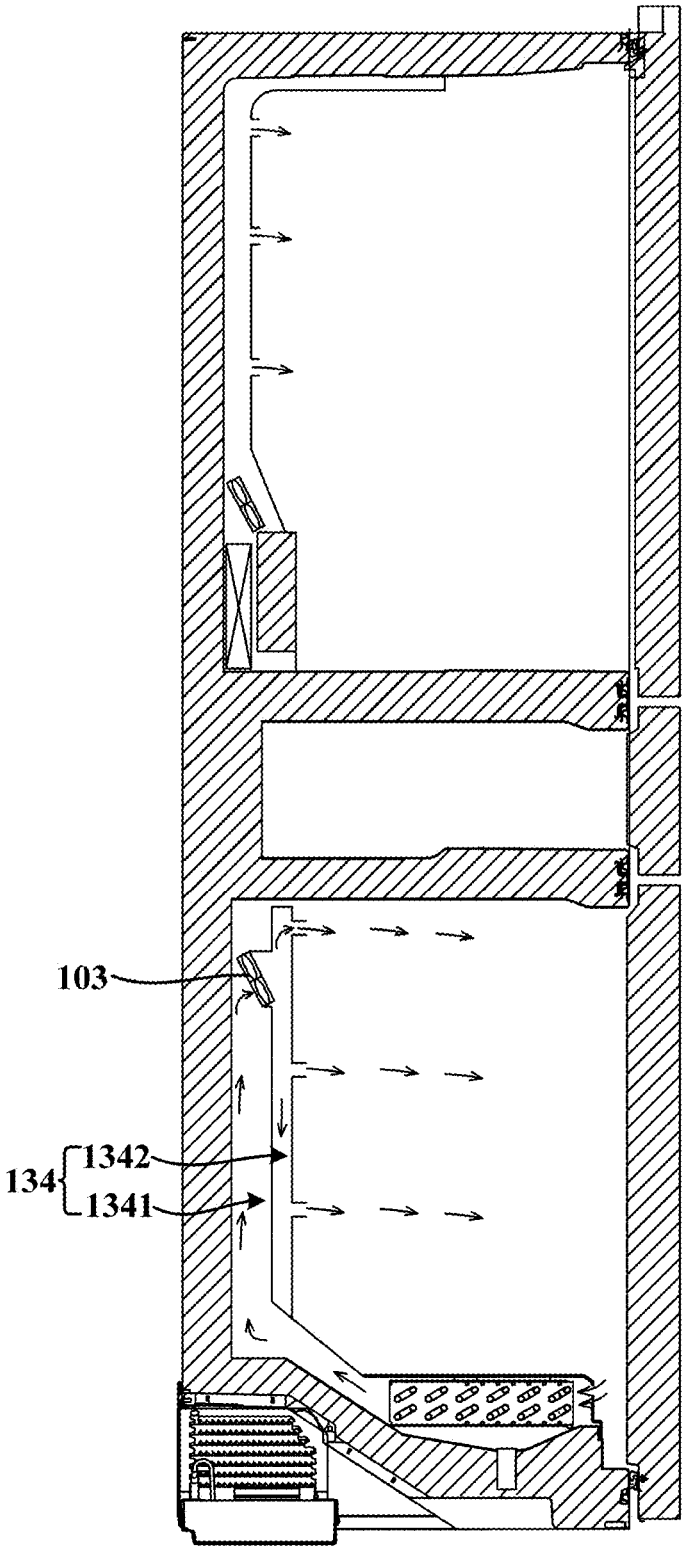
FIG. 7 is a side cross-sectional schematic diagram of a refrigerator according to an embodiment of the present invention, with the air supply fan being an axial flow fan and positioned at the upper end of the air supply duct.
Figure 8:
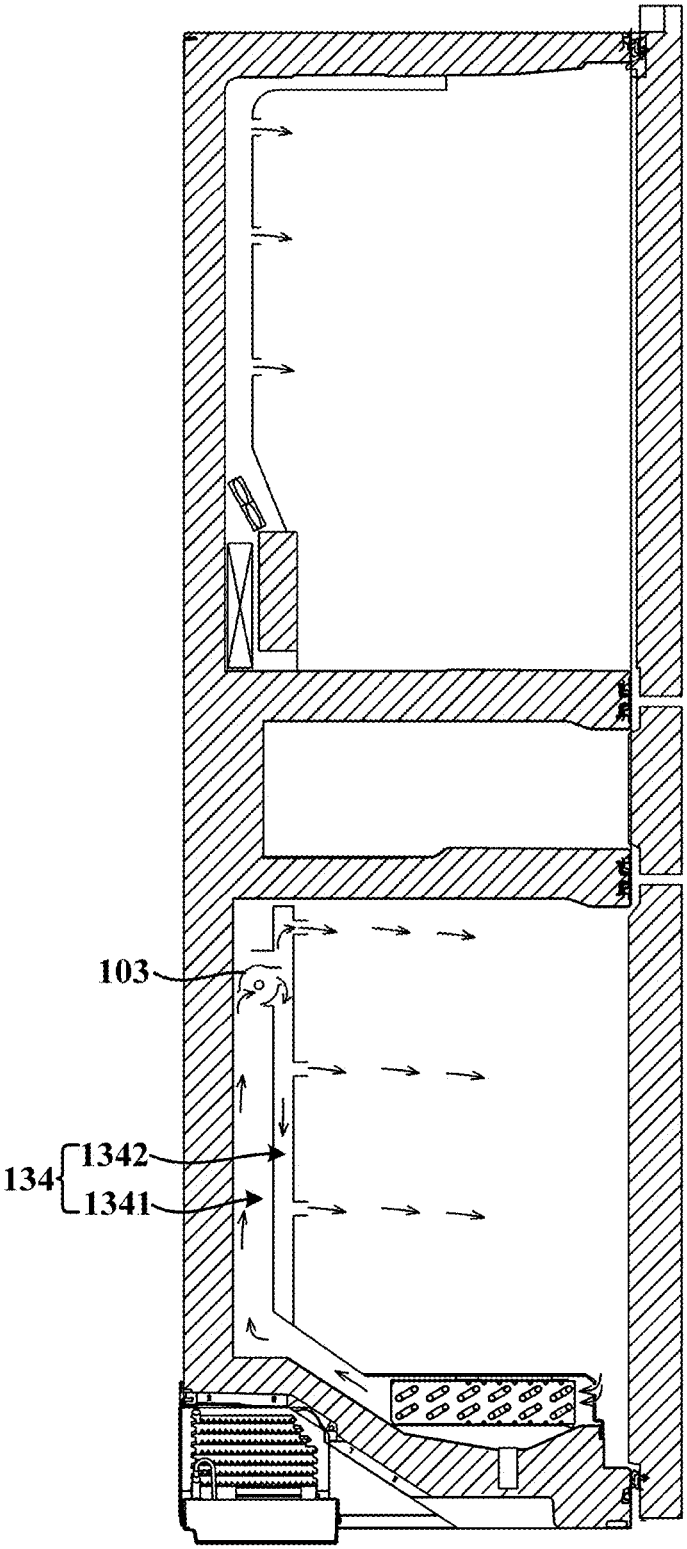
FIG. 8 is a side cross-sectional schematic diagram of a refrigerator according to an embodiment of the present invention, with the air supply fan being a cross-flow fan and positioned at the upper end of the air supply duct.

Referring to FIG. 5, FIG. 7 and FIG. 8, the first air duct section 1341 can extend upwards to a position close to the top wall of the storage liner 130. The upper end of the second air duct section 1342 can extend to a position close to the top wall of the storage liner 130, the lower end of the second air duct section can extend to be connected with the housing 135, and the top end of the second air duct section 1342 is higher than the top end of the first air duct section 1341. The air supply fan 103 is positioned at a position of the second air duct section 1342 above the first air duct section 1341. That is, the air supply fan 103 is approximately positioned at a position close to the top end of the air supply duct 134, so that the thickness of the air supply duct 134 is only increased at the position where the air supply fan 103 is arranged, and the thickness of the whole section of the air supply duct 134 positioned below the air supply fan 103 is relatively small, and thus the volume of the storage compartment 131 is less affected.

At least one second air outlet 1342*a* can be formed in the position of the front wall of the second air duct section 1342 above the air supply fan 103, a plurality of second air outlets 1342*a* which are sequentially distributed at intervals from top to bottom can be formed in the position of the front wall of the second air duct section 1342 below the air supply fan 103, and the air supply fan 103 can suck air from the rear side, and exhaust air to the segments of the second air duct section 1342 above and below the air supply fan 103 respectively, so that it is guaranteed that the cooling air can flow through the whole area in the height direction of the storage compartment 131, and the temperature uniformity of the storage compartment 131 is improved.

Figure 6:
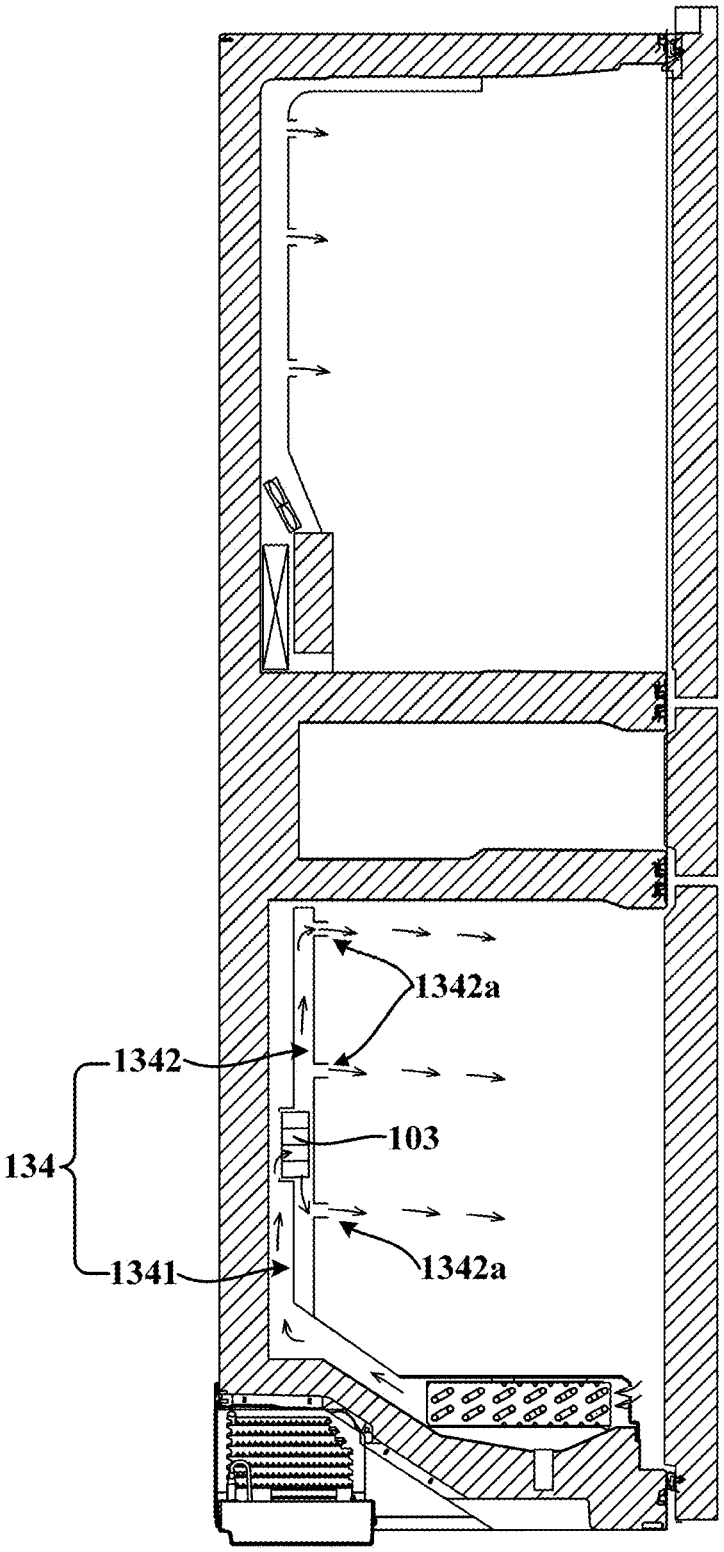
FIG. 6 is a side cross-sectional schematic diagram of a refrigerator according to an embodiment of the present invention, with the air supply fan positioned at an approximately vertical center position of the air supply duct.

Referring to FIG. 6, the first air duct section 1341 can extend upwards to a position corresponding to the approximately vertical center position of the rear wall of the storage liner 130. The upper end of the second air duct section 1342 can extend to a position close to the top wall of the storage liner 130, and the lower end of the second air duct section can extend to be connected with the housing 135. The air supply fan 103 is positioned at the position of the second air duct section 1342 above the first air duct section 1341. That is, the air supply fan 103 is approximately positioned at the approximate center of the air supply duct 134, and sucks air from the rear side and exhausts the air to the segments of the second air duct section 1342 above and below the air supply fan 103 respectively. At least one second air outlet 1342*a* is formed in the position of the front wall of the second air duct section 1342 above the air supply fan 103, and a plurality of second air outlets 1342*a* which are sequentially distributed at intervals from top to bottom are formed in the position of the front wall of the second air duct section 1342 below the air supply fan 103 so as to supply air to all areas in the height direction of the storage compartment 131.

In any preceding embodiment, the air supply fan 103 may be a centrifugal fan, an axial flow fan, or a cross-flow fan. As shown in FIG. 4*a* to FIG. 6, the air supply fan 103 is a centrifugal fan having an axis of rotation extending in the front-back direction. In the embodiment shown in FIG. 4*a*, based on the position of the air supply fan 103, the air supply fan 103 needs to suck air from the front side and exhaust the air upwards. In the embodiments shown in FIG. 5 and FIG. 6, based on the position of the air supply fan 103, the air supply fan 103 sucks air from the rear side and exhausts the air upwards and downwards respectively. In the embodiment shown in FIG. 7, the air supply fan 103 is an axial flow fan, and the axis of rotation of the axial flow fan can be inclined upwards from back to front, which is beneficial to promote the flow of the cooling air to the segments of the second air duct section above and below the air supply fan 103 respectively. In the embodiment shown in FIG. 8, the air supply fan 103 is a cross-flow fan, the axis of rotation of the cross-flow fan can extend laterally, and air is exhausted from the front end of the cross-flow fan, so that the cooling air flows to the segments of the second air duct section above and below the air supply fan 103 respectively.

Figure 9:
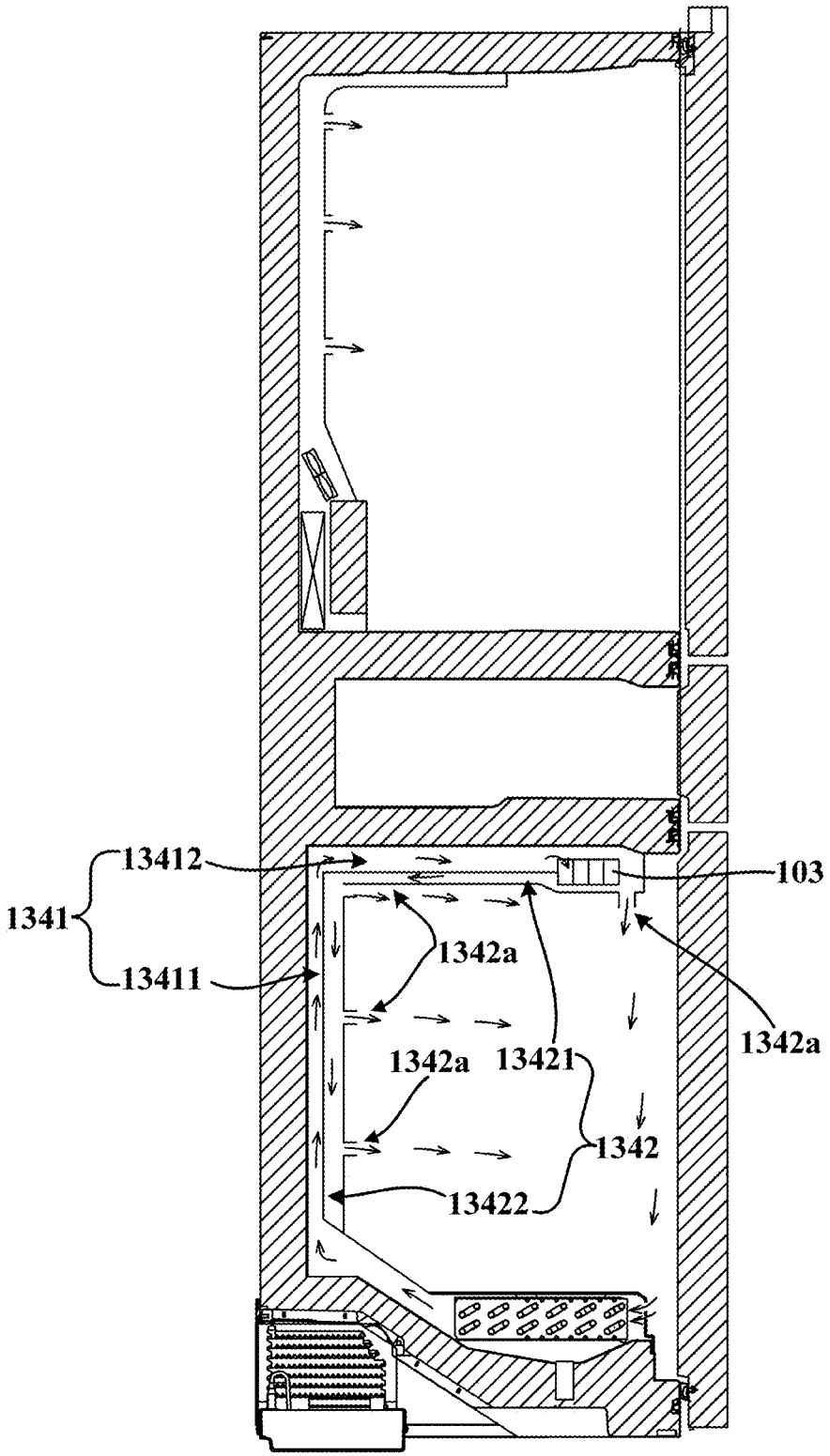
FIG. 9 is a side cross-sectional schematic diagram of a refrigerator according to an embodiment of the present invention, with the air supply fan positioned at the front end of the air supply duct.

In some embodiments, as shown in FIG. 9, the first air duct section 1341 includes a first rear section 13411 positioned on the front side of the rear wall of the storage liner 130 and extending upwards to a position close to the top wall of the storage liner 130, and a first upper section 13412 extending forwards from the upper end of the first rear section 13411. The second air duct section 1342 may include a second upper section 13421 positioned below the first upper section 13412, and a second rear section 13422 extending downwards from the rear end of the second upper section 13421 and positioned in front of the first rear section

13411. At least one air supply fan 103 is disposed at the position of the second upper section 13421 close to the front end. At least one second air outlet 1342*a* is formed in the position of the lower wall of the second upper section 13421 close to the front end, and at least one second air outlet 1342*a* is formed in the front wall of the second rear section 13422. Therefore, air ducts are disposed in the front side of the rear wall and the lower side of the top wall of the storage liner 130, so that air supply uniformity of the storage compartment 131 is improved. Due to the fact that the second air outlet 1342*a* in the second upper section 13421 is close to the front end of the second upper section 13421 (namely close to a door body 132) and supplies air downwards, an air curtain can be formed in front of the storage compartment 131, which is beneficial to maintain temperature stability of the storage compartment 131, and reduce the influence of door opening and closing on the temperature of the storage compartment 131.

In the present embodiment, the air supply fan 103 may be a centrifugal fan, an axial flow fan, or a cross-flow fan. In the embodiment shown in FIG. 9, the air supply fan 103 is a centrifugal fan having an axis of rotation extending in the vertical direction, so that the centrifugal fan sucks air from the upper end and transversely exhausts the air to two sides, so as to promote the cooling air to blow downwards through the second air outlet 1342*a* in the second upper section 13421 to the storage compartment 131, and to blow forwards through the second air outlet 1342*a* in the second rear section 13422 to the storage compartment 131.

In any preceding embodiment, the air supply duct 134 can be defined by at least two air duct cover plates. For example, in the embodiment shown in FIG. 4*a*, the air supply duct 134 is defined by two air duct cover plates positioned on the front side of the rear wall of the storage liner 130. In the embodiments shown in FIG. 5 to FIG. 9, the first air duct section 1341 of the air supply duct 134 is defined by an air duct cover plate and the inner wall of the storage liner 130, and the second air duct section 1342 of the air supply duct 134 is defined by the aforementioned air duct cover plate and the other air duct cover plate.

Referring to FIG. 4*a*, the evaporator 101 as a whole is in a flat box shape and is transversely arranged in the cooling chamber 136, i.e., the length-width face of the evaporator 101 is parallel to the horizontal plane, the thickness face of the evaporator is perpendicular to the horizontal plane, and the thickness is significantly smaller than the length of the evaporator 101. The evaporator 101 is transversely arranged in the cooling chamber 136, so that the evaporator 101 is prevented from occupying more space, and the storage volume of the storage compartment 131 above the cooling chamber 136 is further guaranteed.

Referring to FIG. 4*a*, a front return air inlet 135*a* can be formed in the front wall of the housing 135, and return air of the storage compartment 131 can enter the cooling chamber 136 through the front return air inlet 135*a* to be re-cooled by the evaporator 101, and thus the cooling air can be continuously supplied to the storage compartment 131. Due to the fact that the front return air inlet 135*a* is formed in the front side of the housing 135, and the housing 135 is positioned in the space defined by the storage liner 130, the storage compartment 131 can be in direct communication with the cooling chamber 136 through the front return air inlet 135*a* without disposing a return air duct; thus complex design and mounting are omitted, and cost is reduced.

Figure 10:
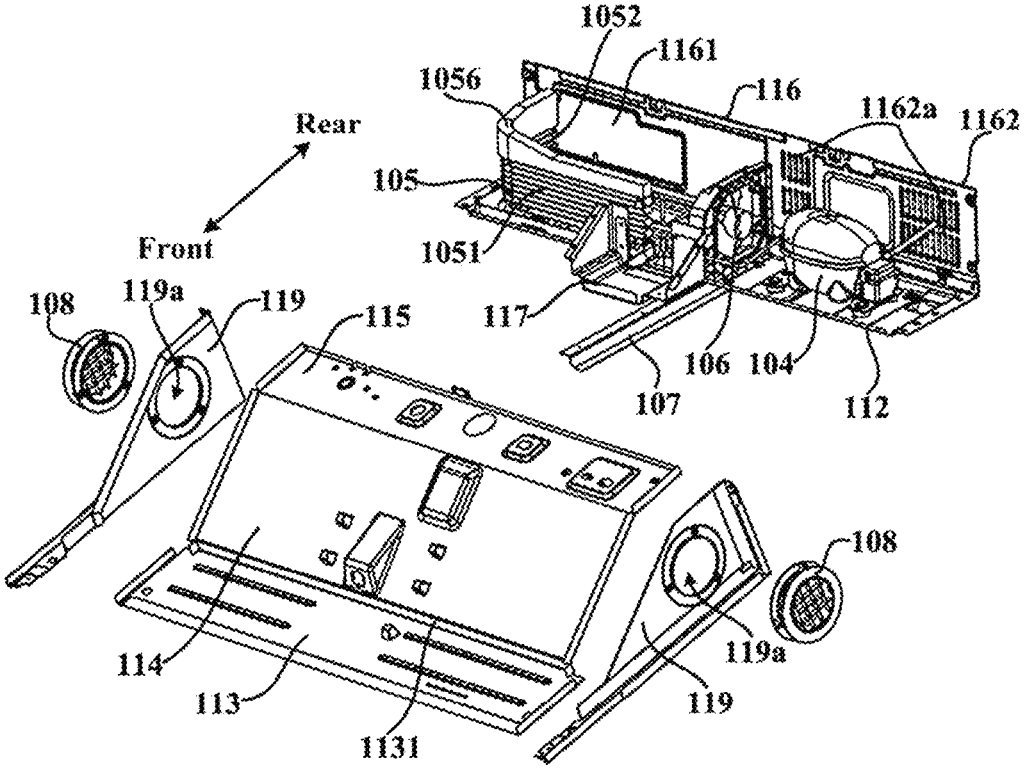
FIG. 10 is a partial exploded schematic diagram of a refrigerator according to an embodiment of the present invention.
Figure 11:
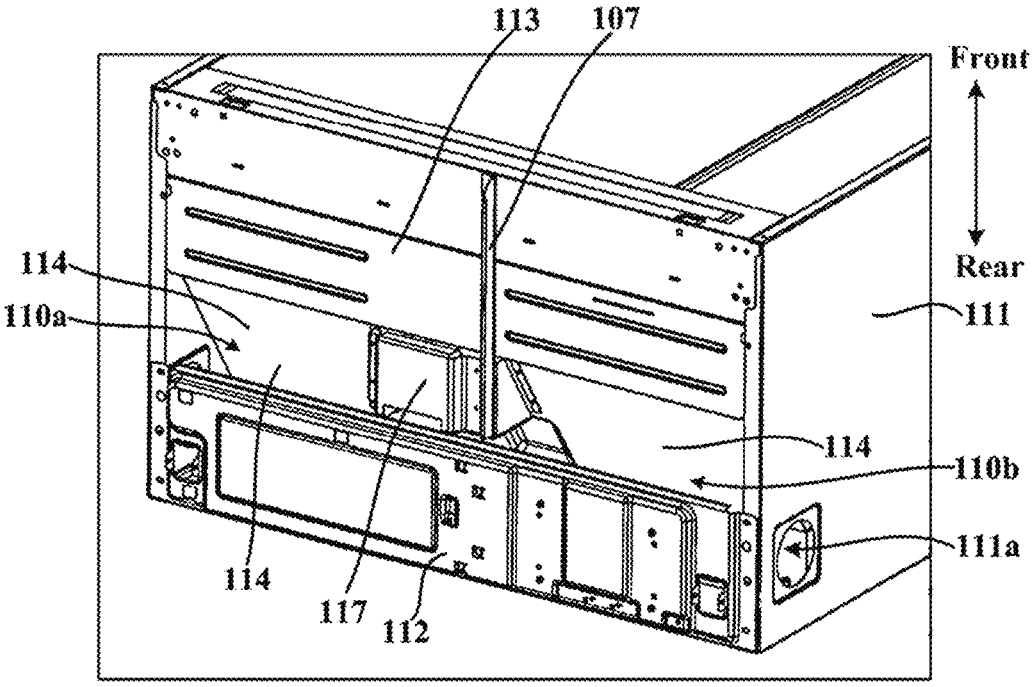
FIG. 11 is a partial schematic diagram of a refrigerator according to an embodiment of the present invention.

Referring to FIG. 10 and FIG. 11, a compressor 104, a heat dissipation fan 106 and a condenser 105 which are sequentially distributed at intervals in the lateral direction are configured in the compressor chamber. Prior to the present application, the design idea of those skilled in the art for a compressor chamber is generally that a rear air inlet facing the condenser 105 and a rear air outlet 1162*a* facing the compressor 104 are provided in the rear wall of the compressor chamber, and thus circulation of heat dissipating airflow is completed at the rear part of the compressor chamber; or ventilation holes are formed in the front wall and the rear wall of the compressor chamber respectively to form a heat dissipating circulation air path in the front-back direction. However, in order to reduce the space in which the refrigerator 100 is positioned, the ventilation space behind the refrigerator is generally small and thus the heat dissipation effect is affected. In particular for an embedded refrigerator, in order to improve the heat dissipation effect, the ventilation space behind the refrigerator needs to be increased, resulting in increase of the occupied space of the refrigerator.

Therefore, the applicants of the present invention break the conventional design idea and creatively propose a new scheme different from the conventional design. According to the present embodiment, a heat dissipation structure of the refrigerator 100 is improved, so that the heat dissipation effect of the compressor chamber can be greatly improved, and meanwhile, the occupied space of the refrigerator 100 is reduced. Specifically, a bottom air inlet 110*a* close to the condenser and a bottom air outlet 110*b* close to the compressor 104 which are distributed in a lateral direction are defined in the bottom wall of the refrigerator 100. The refrigerator 100 completes circulation of the heat dissipation airflow at the bottom, the space between the refrigerator 100 and a supporting surface is fully utilized, the ventilation space behind the refrigerator 100 does not need to be enlarged, the occupied space of the refrigerator 100 is reduced, and meanwhile, good heat dissipation of the compressor chamber is guaranteed, so that the problem that heat dissipation of the compressor chamber and space occupation of the embedded refrigerator 100 cannot be balanced is fundamentally solved, which is of particularly important significance.

The heat dissipation fan 106 is configured to suck ambient air from the ambient environment of the bottom air inlet 110*a* and promote the air to first flow through the condenser 105, then flow through the compressor 104, and finally flow to the ambient environment through the bottom air outlet 110*b*, so that heat from the condenser 105 and the compressor 104 is dissipated.

In a vapor compression refrigeration cycle, the surface temperature of the condenser 105 is generally lower than that of the compressor 104, so the external air is made to cool the condenser 105 first and then cool the compressor 104 in the process above.

In addition, for the problem of improving the heat dissipation effect of the compressor chamber, those skilled in the art generally increase the number of rear air inlets and rear air outlets 1162*a* in the rear wall of the compressor chamber to increase the ventilation area, or increase the heat exchange area of the condenser 105, for example, using a U-shaped condenser with a larger heat exchange area.

The applicants of the present invention creatively recognized that the heat exchange area of the condenser 105 and the ventilation area of the compressor chamber are not as larger as better, and in a conventional design scheme for increasing the heat exchange area of the condenser 105 and the ventilation area of the compressor chamber, the problem of non-uniform heat dissipation of the condenser 105 is caused, and adverse effects are generated on a refrigerating system of the refrigerator 100.

Therefore, the applicants of the present invention break the conventional design idea to further improve the heat dissipation structure of the compressor chamber. At least one rear air outlet 1162*a* is formed in a plate section 1162 of the rear wall of the compressor chamber corresponding to the compressor 104. A plate section 1161 of a back plate 116 (the rear wall of the compressor chamber) facing the condenser 105 is a continuous plate surface. That is, the plate section 1161 of the back plate 116 facing the condenser 105 is not provided with heat dissipation holes, so that the heat dissipation airflow entering the compressor chamber can be sealed at the condenser 105, thus more ambient air entering from the bottom air inlet 110*a* is concentrated at the condenser 105, heat exchange uniformity of all condensation sections of the condenser 105 is guaranteed, a better heat dissipation airflow path is favorably formed, and the better heat dissipation effect can also be achieved. The applicants of the present invention creatively recognized that even on the premise that the heat exchange area of the condenser 105 is not increased, a better heat dissipation airflow path can be formed by reducing the ventilation area of the compressor chamber uncharacteristically, and a better heat dissipation effect can still be achieved.

Moreover, since the plate section 1161 of the back plate 116 facing the condenser 105 is the continuous plate surface and is not provided with the air inlet, it is avoided that in conventional design, air exhaust and air feeding are both concentrated at the rear part of the compressor chamber, which causes that the hot air blown from the compressor chamber is not cooled by the ambient air in time and enters the compressor chamber again, causing adverse effects on heat exchange of the condenser 105, and thus the heat exchange efficiency of the condenser 105 is improved.

Furthermore particularly, the condenser 105 may include a first straight section 1051 extending transversely, a second straight section 1052 extending forwards and rearwards, and a transition curved section (not numbered) connecting the first straight section 1051 and the second straight section 1052, and thus the L-shaped condenser 105 with an appropriate heat exchange area is formed. The plate section 1161 of the rear wall (back plate 116) of the compressor chamber corresponding to the condenser 105 is also the plate section 1161 of the back plate 116 facing the first straight section 1051.

In some embodiments, a side ventilation hole 119*a* can be formed in each of two lateral side walls of the compressor chamber. The side ventilation hole 119*a* can be covered with a ventilation cover plate 108. The ventilation cover plate 108 is provided with grille-type ventilation ports. The shell of the refrigerator 100 includes two lateral cabinet side plates 111. The two cabinet side plates 111 vertically extend to form two side walls of the refrigerator 100, and a side opening 1111*a* in communication with the corresponding side ventilation hole 119*a* is formed in each of the two cabinet side plates 111, so that the heat dissipation airflow flows to the outside of the refrigerator 100, the heat dissipation path is increased, and the heat dissipation effect of the compressor chamber is guaranteed. The ambient airflow entering from the side ventilation holes 119*a* directly exchanges heat with the second straight section 1052, and the ambient air entering from the bottom air inlet 110*a* directly exchanges heat with the first straight section 1051, so that more ambient air entering the compressor chamber is further concentrated at the condenser 105, and the overall heat dissipation uniformity of the condenser 105 is guaranteed.

Referring to FIG. 10 and FIG. 11 again, the refrigerator 100 may include a bottom plate, a supporting plate 112, two side plates 119 and a vertically-extending back plate 116. The supporting plate 112 forms a bottom wall of the compressor chamber for carrying the compressor 104, the heat dissipation fan 106 and the condenser 105. Two side plates 119 form two lateral side walls of the compressor chamber respectively. The vertically-extending back plate 116 forms the rear wall of the compressor chamber.

The bottom plate may include a bottom horizontal section 113 positioned on the front side of the bottom and a bent section bending and extending upwards and rearwards from the rear end of the bottom horizontal section 113. The bent section extends to the upper side of the supporting plate 112. The compressor 104, the heat dissipation fan 106 and the condenser 105 are sequentially arranged on the supporting plate 112 at intervals in the lateral direction, and are positioned in a space defined by the supporting plate 112, the two side plates, the back plate 116 and the bent section.

The supporting plate 112 and the bottom horizontal section 113 jointly form a bottom wall of the refrigerator 100. The supporting plate 112 and the bottom horizontal section 113 are spaced apart to define a bottom opening by the rear end of the bottom horizontal section 113 and the front end of the supporting plate 112. The bent section has an inclined section 114 positioned above the bottom air inlet 110*a* and the bottom air outlet 110*b*. The two side plates extend upwards from two lateral sides of the supporting plate 112 to two lateral sides of the bent section respectively so as to seal two lateral sides of the compressor chamber. The back plate 116 extends upwards from the rear end of the supporting plate 112 to the rear end of the bent section.

Specifically, the bent section may include a vertical section 1131, the aforementioned inclined section 114 and a top horizontal section 115. The vertical section 1131 extends upwards from the rear end of the bottom horizontal section 113. The inclined section 114 extends upwards and rearwards from the upper end of the vertical section 1131 to the upper side of the supporting plate 112. The top horizontal section 115 extends rearwards from the rear end of the inclined section 114 to the back plate, so as to cover the upper sides of the compressor 104, the heat dissipation fan 106 and the condenser 105.

The refrigerator 100 further includes a divider 117 disposed behind the bent section. The front part of the divider is connected with the rear end of the bottom horizontal section 113, and the rear part of the divider is connected with the front end of the supporting plate 112. The divider is configured to divide the bottom opening into the bottom air inlet 110*a* and the bottom air outlet 110*b* which are distributed in a lateral direction.

It can be known from the foregoing that the bottom air inlet 110*a* and the bottom air outlet 110*b* of the present embodiment are defined by the divider 117, the supporting plate 112 and the bottom horizontal section 113, so that the groove-shaped bottom air inlet 110*a* and the groove-shaped bottom air outlet 110*b* with large opening sizes are formed, the air feeding area and the air exhaust area are increased, the air feeding resistance is reduced, making the circulation of airflow smoother, the manufacturing process is simpler, and the integral stability of the compressor chamber is stronger.

In particular, the applicants of the present invention creatively realized that a slope structure of the inclined section 114 is capable of guiding and rectifying feeding airflow, so that the airflow entering from the bottom air inlet 110*a* flows more concentratedly to the condenser 105, avoiding that the airflow is too dispersed to pass more through the condenser 105, thereby further ensuring the heat dissipation effect of the condenser 105. Meanwhile, the slope of the inclined section 114 guides exhausting airflow from the bottom air outlet 110*b* to the front side of the bottom air outlet, so that the exhausting airflow flows out of the compressor chamber more smoothly, and thus the smoothness of airflow circulation is further improved.

Furthermore particularly, in a preferred embodiment, the inclined section 114 has an included angle of less than 45 degrees with the horizontal plane, and in such embodiment, the inclined section 114 is better in airflow guiding and rectifying effect.

Moreover, it is unexpected that the applicants of the present application creatively recognized that the slope of the inclined section 114 provides a better dampening effect on airflow noise, and in prototype tests, noise of the compressor chamber with the aforementioned specially designed inclined section 114 can be reduced by 0.65 decibels or above.

In addition, in the traditional refrigerator 100, the refrigerator 100 is generally provided with a bearing plate of a roughly-flat plate type structure at the bottom, and the compressor 104 is disposed on the inner side of the bearing plate, so vibration generated during operation of the compressor 104 has a large influence on the bottom of the refrigerator 100. In the present embodiment, as previously described, the bottom of the refrigerator 100 is constructed into a solid structure by the specially constructed bottom plate and supporting plate 112, an independent solid space is provided for arrangement of the compressor 104, and the supporting plate 112 is utilized to carry the compressor 104, so that the influence of vibration of the compressor 104 on other components at the bottom of the refrigerator 100 is reduced. In addition, by designing the refrigerator 100 to be of the above ingenious special structure, the bottom of the refrigerator 100 is compact in structure and reasonable in layout, the overall volume of the refrigerator 100 is reduced, meanwhile, the space of the bottom of the refrigerator 100 is fully utilized, and thus the heat dissipation efficiency of the compressor 104 and the condenser 105 is guaranteed.

A wind blocking piece 1056 can be arranged at the upper end of the condenser 105. The wind blocking piece 1056 may be wind blocking sponge for filling a space between the upper end of the condenser 105 and the bent section. That is, the wind blocking piece 1056 covers the upper ends of the first straight section 1051, the second straight section 1052 and the transition curved section, and the upper end of the wind blocking piece 1056 should abut against the bent section to seal the upper end of the condenser 105, so that the situation that part of the air entering the compressor chamber passes through the space between the upper end of the condenser 105 and the bent section and does not pass through the condenser 105 is avoided, thus the air entering the compressor chamber is subjected to heat exchange through the condenser 105 as much as possible, and the heat dissipation effect of the condenser 105 is further improved.

In some embodiments, the refrigerator 100 may further include a wind blocking strip 107 extending forwards and rearwards. The wind blocking strip 107 is positioned between the bottom air inlet 110*a* and the bottom air outlet 110*b*, extends from the lower surface of the bottom horizontal section 113 to the lower surface of the supporting plate 112, and is connected to the lower end of the divider 117, so that the bottom air inlet 110*a* and the bottom air outlet 110*b* are completely isolated by the wind blocking strip 107 and the divider 117, and thus when the refrigerator 100 is positioned on a supporting surface, the space between the bottom wall of the refrigerator 100 and the supporting surface is transversely separated, so as to allow external air to enter the compressor chamber through the bottom air inlet 110*a* positioned on one lateral side of the wind blocking strip 107 under the action of the heat dissipation fan 106, sequentially flow through the condenser 105 and the compressor 104, and finally flow out from the bottom air outlet 110*b* positioned on the other lateral side of the wind blocking strip 107. Therefore, the bottom air inlet 110*a* and the bottom air outlet 110*b* are completely isolated, it is guaranteed that there is no cross flow of the external air entering the condenser 105 and the heat dissipating air exhausted from the compressor 104, and the heat dissipation efficiency is further guaranteed.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

The invention claimed is:

1. A refrigerator, comprising a lowermost storage liner in which a space is defined, the space comprising a storage compartment and a cooling chamber positioned under the storage compartment;

an evaporator disposed in the cooling chamber and configured to cool air passing through the evaporator so as to form cooling air supplied to the storage compartment;

an air supply duct disposed in the space and configured to convey the cooling air to the storage compartment; and at least one air supply fan disposed in the air supply duct and configured to promote air circulation between the cooling chamber and the storage compartment;

wherein a compressor chamber is defined in the refrigerator, the compressor chamber is positioned on the lower rear side of the cooling chamber, and a compressor, a heat dissipation fan and a condenser which are distributed at intervals in a lateral direction are configured in the compressor chamber;

wherein the refrigerator further comprises a bottom plate, a supporting plate, two side plates and a vertically-extending back plate, wherein the supporting plate forms a bottom wall of the compressor chamber and supports the compressor, the heat dissipation fan and the condenser, the two side plates form two lateral side walls of the compressor chamber respectively, and the back plate forms a rear wall of the compressor chamber;

wherein a bottom air inlet close to the condenser and a bottom air outlet close to the compressor which are distributed in the lateral direction are defined in a bottom wall of the refrigerator and face downward a supporting surface on which the refrigerator is placed; and the heat dissipation fan is configured to suck ambient air from the bottom air inlet and promote the air to pass through the condenser first, further pass through the compressor and then flow to an ambient environment from the bottom air outlet;

wherein the refrigerator further comprises:

a divider disposed to separate the bottom air inlet from the bottom air outlet which are distributed in the lateral direction; and a wind blocking strip extending forwards and rearwards, wherein the wind blocking strip is positioned between the bottom air inlet and the bottom air outlet, is connected to a lower end of the divider and protrudes downwards from the bottom wall of the refrigerator towards the supporting surface, and the wind blocking strip and the divider completely isolate the bottom air inlet from the bottom air outlet, so that when the refrigerator is placed on a supporting surface, a space between the bottom wall of the refrigerator and the supporting surface is laterally separated to allow external air to enter the compressor chamber through the bottom air inlet positioned on one lateral side of the wind blocking strip under the action of the heat dissipation fan, sequentially flow through the condenser and the compressor, and finally flow out of the bottom air outlet positioned on the other lateral side of the wind blocking strip.

2. The refrigerator according to claim 1, wherein the bottom plate comprises a bottom horizontal section positioned on the front side of the bottom and a bent section bending and extending rearwards and upwards from a rear end of the bottom horizontal section;

the supporting plate is located behind the bottom horizontal section, the bent section extends to the upper side of the supporting plate, and the supporting plate and the bottom horizontal section form the bottom wall of the refrigerator;

the divider is disposed behind the bent section, a front part of the divider is connected with the rear end of the bottom horizontal section, and a rear part of the divider is connected with a front end of the supporting plate; and the wind blocking strip extends to a lower surface of the supporting plate from a lower surface of the bottom horizontal section.

3. The refrigerator according to claim 2, wherein the side plates extend upwards from two lateral sides of the supporting plate to two lateral sides of the bent section respectively to form two lateral side walls of the compressor chamber;

the back plate extends upwards from a rear end of the supporting plate to a rear end of the bent section to form the rear wall of the compressor chamber; and the compressor, the heat dissipation fan and the condenser are sequentially arranged on the supporting plate at intervals in the lateral direction and positioned in a space defined by the supporting plate, the two side plates, the back plate and the bent section.

4. The refrigerator according to claim 2, wherein the bent section comprises an inclined section positioned above the bottom air inlet and the bottom air outlet, wherein the inclined section allows an airflow entering from the bottom air inlet to flow concentratedly to the condenser, and guides an exhausting airflow from the bottom air outlet to the front side of the bottom air outlet.

5. The refrigerator according to claim 1, wherein the air supply duct is disposed on the front side of a rear wall of the storage liner and in communication with the cooling chamber; and the at least one air supply fan is disposed at a lower end of the air supply duct, and configured to promote at least part of airflow cooled by the evaporator to be conveyed into the storage compartment through the air supply duct.

6. The refrigerator according to claim 5, wherein the at least one air supply fan is disposed at the lower end of the air supply duct with a rotation axis of each air supply fan being disposed horizontally.

7. The refrigerator according to claim 1, wherein at least one first air outlet for blowing the cooling air to the storage compartment is formed in a front wall of the air supply duct.

8. The refrigerator according to claim 1, wherein the evaporator is in a flat box shape and laterally arranged in the cooling chamber.

9. The refrigerator according to claim 1, further comprising:

a housing disposed in the space defined by the storage liner and configured to divide the space into the cooling chamber and the storage compartment, wherein the housing covers a bottom wall of the storage liner, and defines the cooling chamber together with the bottom wall and two lateral side walls of the storage liner.

10. The refrigerator according to claim 9, wherein a front return air inlet is formed in a front wall of the housing, so that return air of the storage compartment enters the cooling chamber through the front return air inlet to be cooled by the evaporator;

an air duct inlet in communication with the cooling chamber is formed in a front wall face of a lower end of the air supply duct; and an airflow outlet of the cooling chamber in communication with the air duct inlet is formed in a rear end of the housing.

11. The refrigerator according to claim 1, wherein the storage liner is a freezing liner, and the storage compartment is a freezing chamber; and the refrigerator further comprises:

two variable-temperature liners distributed in a lateral direction and positioned right above the freezing liner, a variable-temperature chamber being defined in each of the variable-temperature liners; and a refrigerating liner positioned right above the two variable-temperature liners, a refrigerating chamber being defined in the refrigerating liner.

12. The refrigerator according to claim 2, wherein the supporting plate and the bottom horizontal section are spaced apart so as to define a bottom opening by the rear end of the bottom horizontal section and the front end of the supporting plate; and the divider divides the bottom opening into the bottom air inlet and the bottom air outlet which are distributed in the lateral direction.

* * * * *